United States Patent [19]

Radtke et al.

[11] Patent Number: 4,852,787

[45] Date of Patent: Aug. 1, 1989

[54] STOCK FEEDING MECHANISM FOR PRESS

[75] Inventors: Dale F. Radtke, Jefferson; Ronald F. Rutke, Milwaukee, both of Wis.

[73] Assignee: R & R Engineering, Inc., Jefferson, Wis.

[21] Appl. No.: 125,669

[22] Filed: Nov. 27, 1987

[51] Int. Cl.[4] ..... B65H 20/04

[52] U.S. Cl. ..... 226/142; 226/149; 226/151; 226/152; 226/158

[58] Field of Search ..... 226/134, 136, 137, 147, 226/148, 149, 152, 156, 162, 164, 142, 139, 141

[56] References Cited

U.S. PATENT DOCUMENTS

| | | | |
|---|---|---|---|
| 438,528 | 10/1890 | Cox . | |
| 1,652,617 | 12/1927 | Eurit . | |
| 2,039,848 | 5/1936 | Howland-Shearman | 74/600 |
| 3,200,686 | 8/1965 | Norton et al. | 226/147 X |
| 3,242,768 | 3/1966 | Munschauer, Jr. | 74/600 |
| 3,405,856 | 10/1968 | Mogolis | 226/154 |
| 3,466,906 | 9/1969 | Bergevin | 72/36 |
| 3,863,823 | 2/1973 | Allred | 226/142 |

FOREIGN PATENT DOCUMENTS

| | | | |
|---|---|---|---|
| 1042855 | 9/1983 | U.S.S.R. | 226/158 |

*Primary Examiner*—Stanley N. Gilreath

*Attorney, Agent, or Firm*—Quarles & Brady

[57] ABSTRACT

A pair of rollers receives the stock between them and are movable laterally in unison to advance the stock gripped between them in a feeding movement. A slide block is slidably carried by a disk and is provided with a coupling that is offset from the axis of the disk. The coupling is connected to the pair of rollers so that rotation of the disk will move them in their lateral movement. The length of the feeding movement is adjusted by moving the slide block relative to the disk to adjust the distance between the coupling and the axis of the disk. The slide block is provided with a measuring surface that is located so that the distance from the measuring surface to the reference surface corresponds to one-half the length of the feeding movement. The slide block is clamped in position by a locking plate that is slidably supported by the disk. By moving the plate so that an inclined edge moves along an inclined edge on the disk, a locking edge of the plate is moved into tight engagement with the edge of the slide block to clamp the block in the selected position. The pair of rollers are biased into tight engagement with each other by a spring. The pressure of the spring on the rollers can be relieved by pivoting a cam that bears against the spring and is mounted on the end of a pivotable lever.

3 Claims, 3 Drawing Sheets

STOCK FEEDING MECHANISM FOR PRESS

BACKGROUND OF THE INVENTION

The present invention pertains to automatic feeding mechanisms for feeding stock into a machine such as feeding strip stock into a power operated press.

Automatic feeding mechanisms are available for feeding stock into a machine, as for example, the feeding mechanism disclosed in U.S. Pat. No. 3,863,823 dated Feb. 4, 1975. Such feeding mechanisms are automatic in operation but must be initially adjusted for each job to obtain the correct amount of feed for each stroke of the machine and to adjust for proper gripping of the stock depending upon its thickness.

It is important that the adjustment for the length of feeding movement of the stock be accurate so that the amount of stock fed into the machine for each cycle of the feeding mechanism is precisely the specified length for the particular work operation being performed.

Moreover, the feeding mechanism operates at very high speeds and therefore has a tendency to shift out of its adjustment. It is therefore important that the mechanism be securely locked in its adjusted position.

During the feeding operation the stock passes through two pair of rollers that produce the feeding movement. One pair of rollers grips the stock and then moves forwardly to advance the stock through the second pair of rollers. The latter, in turn grip the stock to prevent it from shifting backwardly during the return movement of the first pair of rollers to their starting position. The spacing of the two rollers of each pair must be readily adjusted to accommodate the thickness of the stock being operated upon so that the feeding movement of the stock proceeds efficiently with the required accuracy.

SUMMARY OF THE INVENTION

The present invention provides an improved mechanism for adjusting the length of the advancing movement of the stock during the operation of the feeding mechanism for feeding stock into the machine. The feeding mechanism includes a rotary disk having a block slidably mounted along the diameter of the disk to vary its distances from the center of the disk. The block is connected as a crank to reciprocate the feeding rollers as the disk rotates for feeding the stock. The length of the stroke is determined by the distance of the block from the center of the disk.

According to the present invention the block is provided with an indicator rod that presents a flat surface on its end which can be precisely calibrated with respect to a reference surface so that the distance between the reference surface and the flat end of the indicator rod is equal to one-half the length of the feeding movement. The reference surface is so disposed with respect to the flat on the indicator rod that the distance can be conveniently and accurately measured with a precision measuring instrument such as a dial caliper, a dial indicator or a depth micrometer.

Once the block is in the selected position to produce the desired length of feed it must be securely locked in that position to prevent its shifting during the operation of the feeding mechanism. The present invention provides a slidable locking plate having a straight locking edge abutting a cooperating straight edge on the block. The opposite edge of the locking plate is inclined for engagement with a complementary inclined edge formed on a support that is fixed to the disk. A screw is rotatably supported by a member on the disk in threaded engagement with the locking plate for producing its sliding movement. Rotation of the screw in one direction serves to tightly wedge the locking plate between the inclined edge and the straight edge on the block. Rotation of the screw in the opposite direction shifts the locking plate in a direction to relieve the wedging action and thereby release the block for movement along the diameter of the disk so that required adjustments can be readily made.

The present invention also provides for improved mounting of the two pairs of rollers that effect the feeding movement. They are arranged for more efficient and convenient operation. To this end, the rollers of each pair are biased toward each other by a spring with sufficient force to operably secure the stock between them and yet will yield sufficiently to accommodate all thicknesses of the stock without the need of repositioning one of the rollers relative to the other to space the rollers according to the stock. In addition a cam carrying lever is provided that can be pivoted to compress the spring for relieving the pressure that forces one of the rollers into operating engagement with its cooperating roller and thereby space the rollers to greatly facilitate the set up procedure in preparation for a work operation.

DESCRIPTION OF THE PREFERRED EMBODIMENT

Figure 1:
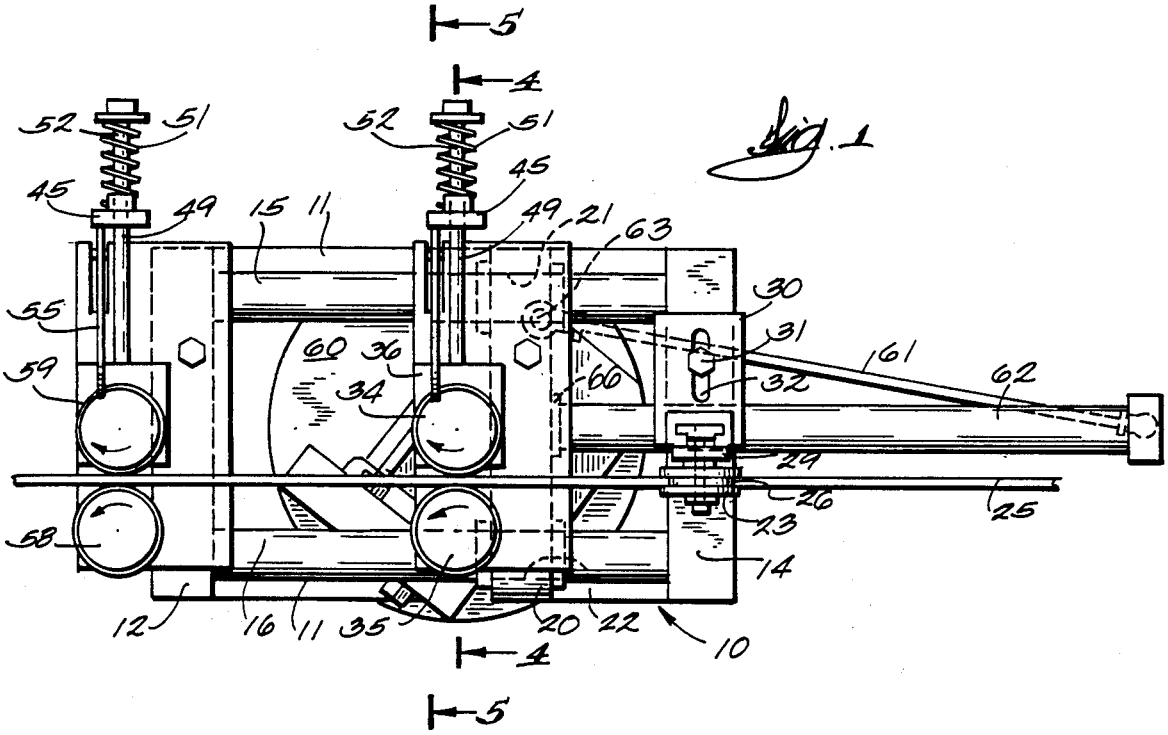
FIG. 1 is a plan view of a stock feeding mechanism incorporating the features of the present invention.
Figure 2:
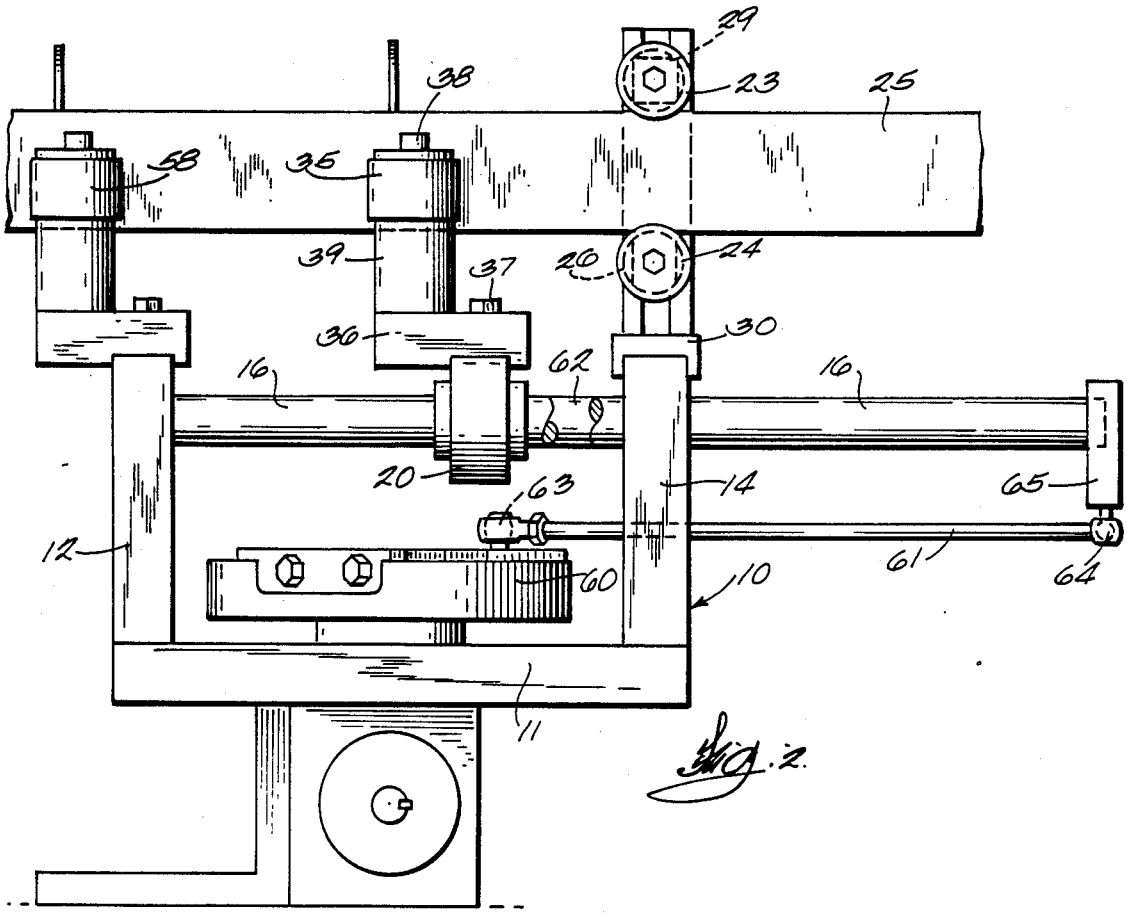
FIG. 2 is a front elevational view of the stock feeding mechanism shown in FIG. 1.

Reference is now made more particularly to the drawings and specifically to FIG. 1 thereof which illustrates a stock feeding mechanism incorporating the features of the present invention. As there shown, the stock feeding mechanism comprises a frame generally identified by the reference numeral 10 and functioning to support the operating mechanism. The frame 10 includes a base 11 having an upstanding member 12 at one end and a cooperating upstanding member 14 at the other end as best seen in FIG. 2. The members 12 and 14 are fixed to the base 11 and support between them a pair of parallel spaced rods 15 and 16. The rods 15 and 16 slidably support a movable member 20 between the fixed members 12 and 14. To this end, the rod 15 extends through a bore 21 formed at one end of the movable member 20 while the rod 16 extends through another bore 22 formed at the opposite end of the movable member 20. The movable member is thus slidably supported by the two rods 15 and 16.

The stock 25 which is being fed into the press is received from a source (not shown) and passes between a pair of guide rollers 23 and 24 as clearly shown in FIG. 2. The guide rollers 23 and 24 are provided with a centrally located annular peripheral groove 26 for receiving the edges of the stock 25.

The guide rollers 23 and 24 are rotatably supported in a vertical plane by a plate 29 that extends upwardly from a base 30 that is mounted on the top edge of the upstanding member 14. The base 30 is secured to the member 14 by a screw 31 which extends through a slot 32 formed in the base 30. The slot 32 enables the base 30 to be adjusted in a horizontal direction relative to the member 14 to adjust the position of the guide rollers 23 and 24.

Figure 4:
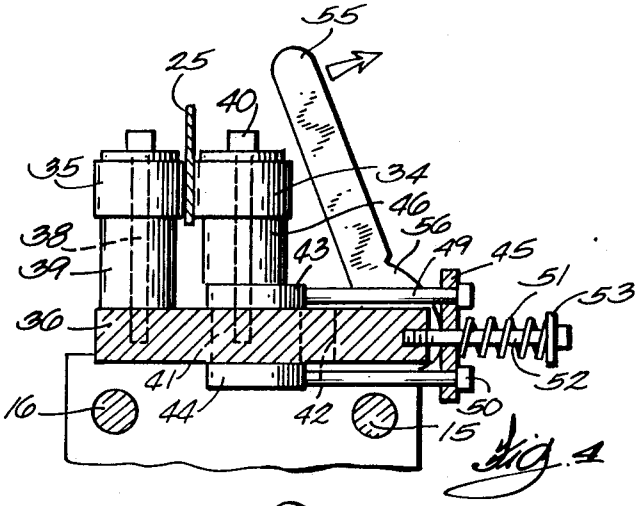
FIG. 4 is a view in vertical section taken along the plane represented by the line 4—4 in FIG. 1.

From the guide rollers 23 and 24 the stock 25 passes through a pair of feed rollers 34 and 35 which are carried by the movable member 20 for effecting the feeding movement of the stock 25. The roller 35 is supported by a plate 36 that is secured to the movable member 20 by a screw 37. As shown in FIG. 4, the roller 35 is journaled on a shaft 38 that extends upwardly from the plate 36, with a spacer 39 being provided to space the roller 35 upwardly of the plate 36.

Figure 5:
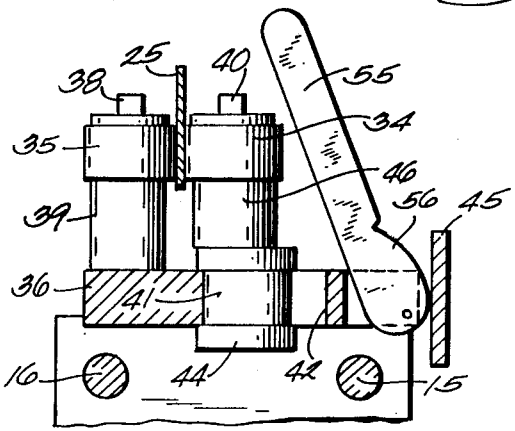
FIG. 5 is a view in vertical section taken along the plane represented by the line 5—5 in FIG. 1.
Figure 3:
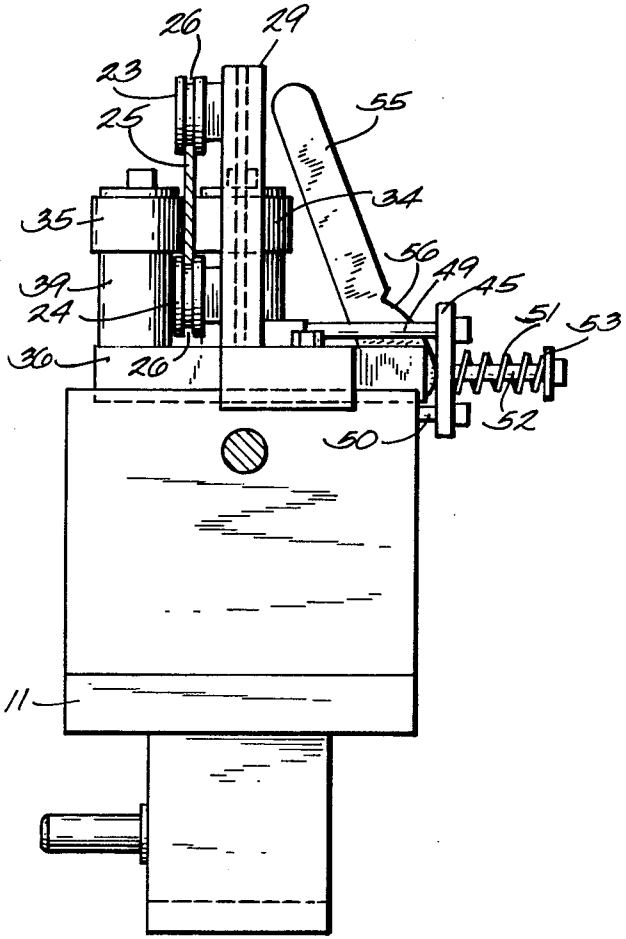
FIG. 3 is a right end view of the stock feeding mechanism depicted in FIG. 1.

The roller 34 on the other hand is rotatably supported by a shaft 40 that extends upwardly from a block 41 through a spacer 46 as best shown in FIGS. 4 and 5. The block 41 is movable within a slot 42 formed in the plate 36 and is retained within the slot 42 by a pair of flanges 43 and 44. The block 41 is coupled to a plate 45 by a pair of rods 49 and 50. A compression spring 51 is mounted on a stud 52 and is compressed between a washer 53 mounted on the stud 52 and the plate 45.

With this arrangement, the spring 51 is forcing the plate 45 to the left as viewed in FIG. 4 and this force is transmitted to the block 41 by the rods 49 and 50. Since the roller 34 is carried by the block 41 it is forced into tight engagement with the roller 35.

The spring 51 will yield sufficiently to accommodate all thicknesses of stock that are fed between the rollers 34 and 35. However, when setting the feeding mechanism for a work operation it is convenient to release the tight engagement between the two rollers. This is accomplished by pivoting a lever 55 in the direction of the arrow illustrated in FIG. 4 to produce a corresponding pivotal movement of its associated cam 56. The cam 56 is in engagement with the plate 45 and as the cam pivots in a clockwise direction, its cam surface bears against the plate 45 to force it to the right as viewed in FIG. 4 to move the roller 34 with it for relieving the pressure of the roller 34 against its cooperating roller 35.

From the rollers 34 and 35 the stock 25 passes between a pair of clamping rollers 59 and 58 which serve to secure the stock 25 to prevent it from moving backwardly with the return movement of the rollers 34 and 35. The rollers 59 and 58 are mounted in the same manner as the rollers 34 and 35, being held in tight engagement with each other by the spring 51 which may be released by pivotal movement of the lever 55 in the same manner as described for the operation of the rollers 34 and 35.

The rollers 34 and 35 as well as the rollers 59 and 58 are journaled by suitable roller bearings but are provided with a one-way clutch so that they will rotate in one direction only. Thus, the rollers 34 and 59 rotate in a clockwise direction only as indicated by the arrows in FIG. 1. On the other hand, the rollers 35 and 60 rotate in a counterclockwise direction only and will not rotate in a clockwise direction.

The feeding movement is obtained by producing a rectilinear movement of the movable member 20 to cause the rollers 34 and 35 to move with it laterally. Since the stock 25 is securely clamped between the two rollers 34 and 35 and the rollers will not rotate in a direction to permit rearward movement of the stock 25, the stock is fed forwardly to advance it toward the machine. The rollers 59 and 58 will roll with the movement of the stock 25 to freely admit it past this point. During the retracting movement of the rollers 34 and 35 the rollers 34 and 35 will rotate along the surface of the stock 25. However, during this retracting movement, the rollers 59 and 50 lock to prevent rearward movement of the stock 25 with the rollers 34 and 35, the stock 25 being securely clamped between the two locked rollers 59 and 58.

The rollers 34 and 35 are driven in their rectilinear feeding movement by a rotating disk 60 which is coupled to be rotated by a power drive from the machine tool to which the stock 25 is being fed. The disk 60 is coupled to the movable member 20 by means of a link 61 and a rod 62. One end of the link 61 is connected to the disk 60 by means of a universal coupling 63 while its opposite end is connected to the rod 62 by means of a coupling 64 and a connecting member 65 that is mounted on the extending end of the rod 62. The opposite end of the rod 62 is provided with a flange 66 that is secured to the face of the movable member 20 so that the latter will move in unison with the axial movement of the rod 62. The rod 62 passes through a suitable bore formed in the upstanding member 14 so that it is free to reciprocate therein.

The coupling 63 is offset from the axis of the disk 60 so that it rotates in a circle, moving the link 61 with it and thereby producing a reciprocal movement of the rod 62 and its associated movable member 20.

Figure 7:
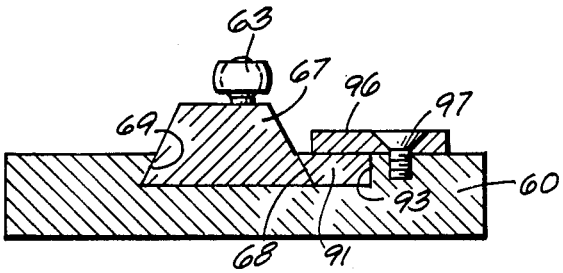
FIG. 7 is a sectional view taken along the plane represented by the line 7—7 in FIG. 6.

The length of the movement of the movable member 20 depends upon the distance of the coupling 63 from the axis of the disk 60. Therefore, in order to adjust the feeding movement of the stock 25, the position of the coupling 63 on the disk 60 is adjusted. To this end, the coupling 63 is mounted on a slide block 67 that is supported by the disk 60 for sliding movement between a pair of guides 68 and 69 as best shown in FIG. 7. The position of the slide block 67 along the guides 68 and 69 can be readily adjusted by rotating an adjusting screw 70.

Figure 6:
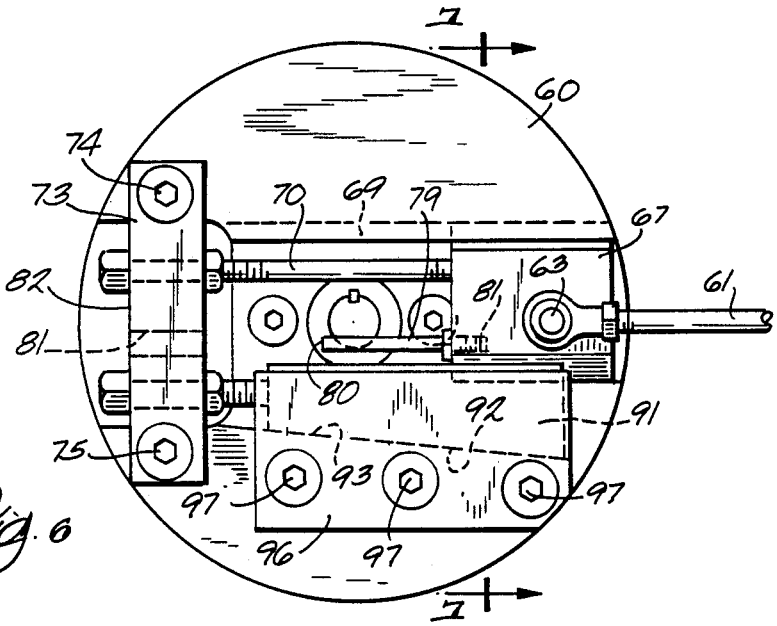
FIG. 6 is a detail plan view depicting the rotary disk for driving the feeding mechanism and the elements associated with it.

The screw 70 is rotatably supported by a bar 73 and axially fixed thereto as best shown in FIG. 6. The bar 73 is mounted on the disk 60 being attached thereto by a pair of screws 74 and 75. The screw 70 extends from the bar 73 into threaded engagement with the slide block 67 so that rotation of the screw 70 will cause a rectilinear movement of the slide block 67 along the guides 68 and 69. Thus, by the simple expedient of rotating the screw 70, the length of the stock 25 that will be fed towards the machine tool for every cycle of the feeding mechanism may be readily adjusted.

The present invention also provides for conveniently and accurately establishing the position of the slide block 67 to precisely set the amount of feeding movement of the stock 25. To this end, a measuring or indicator rod 79 extends from the slide block 67 to present a flat surface 81 at its end which constitutes the measuring surface. The opposite end of the measuring rod 79 is provided with a thread for engagement with a complementary thread formed in the slide block 67. The axial position of the measuring rod 79 can be therefore adjusted by rotating the rod 79 relative to the slide block 67 to locate the end surface 80 for indicating the position of the slide block on the disk 60 and thereby indicate the amount of feeding movement of the stock 25 for each cycle of the feeding mechanism.

Figure 8:
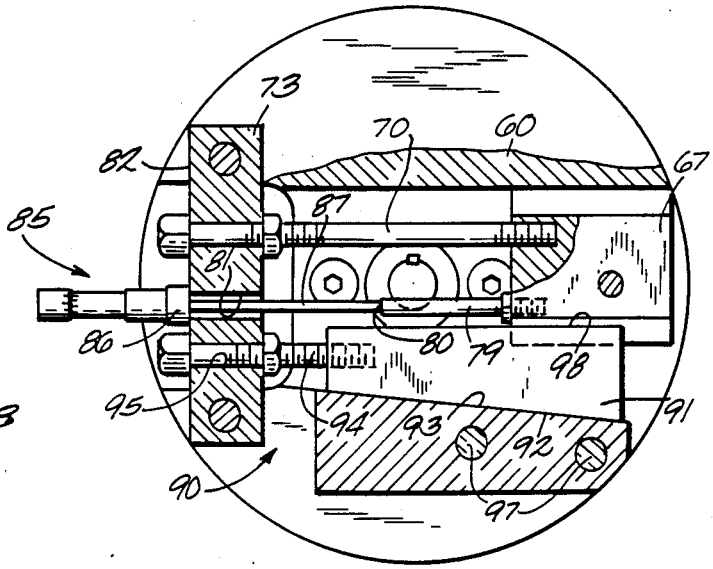
FIG. 8 is a fragmentary view illustrating a measuring instrument applied to measure the adjustment for setting the length of feeding movement of the stock during each cycle of the feeding mechanism.

The measuring rod 79 is in alignment with a hole 81 formed in the bar 73 for receiving a measuring instrument. The measuring rod 79 is calibrated so that the distance from a reference surface 82 of the bar 73 to the surface 80 of the measuring rod 79 corresponds to one-half the feeding movement of the stock 25 for each cycle of the feeding mechanism. This distance can be accurately measured by a dial caliper or, as shown in FIG. 8, by a depth micrometer generally identified by the reference numeral 85. Thus, the bar 86 of the depth micrometer 85 is placed against the reference surface 82 of the bar 73 and a pin 87 of the depth micrometer 85 is passed through the hole 81 of the bar 73 so that its end abuts the end surface 80 of the measuring rod 79. The depth micrometer will then indicate the exact distance between the surface 82 and the surface 80 which is a precise measurement of one-half the amount of feeding movement to be produced by rotation of the disk 60.

Once the exact amount of feeding movement is established, the slide block 67 must be securely locked in position to prevent its movement during the operation of the feeding mechanism to prevent it from shifting during the relatively high rate of rotation of the disk 60. The present invention therefore provides an improved clamping mechanism generally identified by the reference numeral 90 for clamping the slide block 67 in the selected position. The improved clamping mechanism comprises a locking plate 91 that presents a straight locking edge 98 for engagement with the guide 68 as best seen in FIG. 7. The opposite edge 92 of the locking plate 91 is tapered for engagement with a complementary tapered surface 93 formed in the body of the disk 60.

The locking plate 91 is in threaded engagement with a screw 94 that extends through a hole 95 formed in the bar 73 to be rotatably supported and axially secured thereby. Rotation of the screw 94 will therefore produce longitudinal movement of the locking plate 91. The latter is held in position and covered by a plate 96 that is fixed to the disk 60 by three screws 97.

Rotating the screw 94 in a clockwise direction serves to shift the locking plate 91 to the left as viewed in FIG. 8 causing the tapered surface 92 of the locking plate 91 to ride along the tapered surface 93 to produce a shifting of the plate 91 towards the slide block 67. This produces a tight engagement of the straight locking edge 98 of the locking plate 91 against the slide block 67 to securely lock the latter in position. When it is desired to adjust the position of the slide block 67 it is only necessary to rotate the screw 94 in a counterclockwise direction to force the locking plate 91 toward the right as viewed in FIG. 8 for releasing the tight engagement of the edge 98 with the slide block 67.

From the foregoing detailed description of the illustrative embodiment set forth herein to exemplify the present invention, it will be apparent that there has been provided an improved stock feeding mechanism for feeding strip stock into a machine tool. The feeding mechanism of the present invention provides an improved adjusting unit for accurately setting the length of the feeding movement of the stock for each cycle of the machine. In addition, there is provided an improved locking mechanism for locking the adjusting unit in the selected position. There is also provided an improved mounting for controlling the spacing of the two pair of rollers through which the stock passes during the feeding movement.

Although the illustrative embodiment of the invention has been described in considerable detail for the purpose of disclosing a practical, operative structure whereby the invention may be practiced advantageously, it is to be understood that the particular apparatus described is intended to be illustrative only, and that the various novel characteristics of the invention may be incorporated in other structural forms without departing from the spirit and scope of the invention as defined in the subjoined claims.

We claim:

1. A feeding mechanism for feeding stock into a machine comprising; a frame; gripping means carried by said frame for rectilinear movement and adapted to grip the stock that is being fed to the machine, drive means connected to move said gripping means to move the gripped stock in a feeding movement; a slide block slidably supported by said drive means for movement along a predetermined path of travel; means connecting said slide block to said gripping means for coupling said drive means thereto; means for moving said slide block relative to said drive means for adjusting the length of the feeding movement of the stock for each cycle of the feeding mechanism; a reference surface fixedly mounted on said drive means; a measuring surface movable with said slide block relative to said reference surface and calibrated so that the distance between said reference surface and said measuring surface is equal to the feeding movement of said stock during each cycle of the feeding mechanism; a locking plate slidably supported by said drive means; a locking edge on said locking plate in engagement with one edge of said slide block; a tapered edge formed on said locking plate opposite its locking edge; a complementary tapered edge presented by said drive means for engagement with said tapered edge of said locking plate; and means for moving said locking plate for sliding its tapered edge along the complementary tapered edge on said drive means for causing said locking edge to shift into tight engagement with said slide block for securely locking the latter in its adjusted position.

2. A feeding mechanism for feeding stock into a machine comprising; a frame, gripping means carried by said frame for movement and adapted to grip the stock that is being fed to the machine; drive means having a body and connected to move said gripping means for moving the gripped stock in a feeding movement; a slide block slidably supported by said drive means for movement along a predetermined path of travel; means connecting said slide block to said gripping means for coupling said drive means thereto; means for moving said slide block relative to said drive means for adjusting the length of the feeding movement of the stock for each cycle of the feeding mechanism; a locking plate slidably supported by the body of said drive means; a locking edge on said locking plate in engagement with one edge of said slide block, a tapered edge formed on said locking plate opposite its locking edge; a complementary tapered edge formed in the body of said drive means for engagement with said tapered edge of said locking plate; and means for moving said locking plate for sliding its tapered edge along the complementary tapered edge on the body of said drive means for shifting said locking edge into tight engagement with said slide block for securely locking the latter in its adjusted position.

3. A feeding mechanism according to claim 2 wherein said drive means comprises a disk rotatably supported by said frame and driven by a source of power; means slidably supporting said slide block on said disk for movement along the diameter of the disk; and said means connecting said slide block to said gripping means comprises a coupling on said slide block in position to be located a distance from the axis of said disk with the movement of said slide block serving to adjust such distance for adjusting the length of the feeding movement; and a linkage connecting said coupling to said gripping means.

* * * * *